US006035161A

United States Patent [19]

Fiore et al.

[11] Patent Number: 6,035,161

[45] Date of Patent: Mar. 7, 2000

[54] DEVELOPER BACKER BAR THAT ALLOWS A LARGE AMOUNT OF PHOTORECEPTOR WRAP WITH MINIMAL SURFACE CONTACT AREA FOR GREATER AXIAL MISALIGNMENT

[75] Inventors: Steven J. Fiore, Hilton; Frank A. Porter, Penfield; Lam F. Wong, Fairport, all of N.Y.

[73] Assignee: Xerox Corporation, Stamford, Conn.

[21] Appl. No.: 09/105,933

[22] Filed: Jun. 26, 1998

[51] Int. Cl.[7] ..... G03G 15/00

[52] U.S. Cl. ..... 399/164; 399/222

[58] Field of Search ..... 399/162, 164, 399/222, 252, 265, 267, 279

[56] References Cited

U.S. PATENT DOCUMENTS

| | | | |
|---|---|---|---|
| 4,279,496 | 7/1981 | Silverberg | 399/164 |
| 4,806,991 | 2/1989 | Guslits | 399/164 |
| 5,168,318 | 12/1992 | Haneda et al. | 399/164 |
| 5,243,384 | 9/1993 | Everdyke et al. | 355/212 |
| 5,338,893 | 8/1994 | Edmunds et al. | 118/647 |
| 5,585,892 | 12/1996 | Hayano et al. | 399/164 |
| 5,708,924 | 1/1998 | Shogren et al. | 399/116 |
| 5,953,565 | 9/1999 | Fiore et al. | 399/164 |

FOREIGN PATENT DOCUMENTS

| | | |
|---|---|---|
| 0 334 581 A2 | 9/1989 | European Pat. Off. . |
| 0 424 137 A2 | 4/1991 | European Pat. Off. . |
| 60-164778 | 8/1985 | Japan . |
| 7-295438 | 11/1995 | Japan . |

OTHER PUBLICATIONS

Research Disclosure, "Photoconductor–Development Applicator Spacing Mechanism", Jun. 1994, No. 362, Emsworth, GB, p. 281, XP 000461247.

Patent Application 08/838,631, entitled "Developer Backer Bar That Allows Axial Misalignment Between the Backer Bar and The Developer Donor Roll", filed Apr. 11, 1997.

*Primary Examiner*—William Royer
*Assistant Examiner*—William A. Noë
*Attorney, Agent, or Firm*—Kevin R. Kepner

[57] ABSTRACT

A developer backer bar having a surface having a plurality of radii for interfacing with a noncontact developer member. The backer bar is arranged so that it can be retracted for clearance purposes when removing or inserting a xerographic CRU. Upon installation of the CRU, the backer bar is biased into position to maintain a development zone within predetermined parameters. The multiple radii surface eliminates or minimizes errors that may result from slight variations in axial alignment between the backer bar and the developer member while additionally providing low drag forces on the photoreceptor.

3 Claims, 7 Drawing Sheets

DEVELOPER BACKER BAR THAT ALLOWS A LARGE AMOUNT OF PHOTORECEPTOR WRAP WITH MINIMAL SURFACE CONTACT AREA FOR GREATER AXIAL MISALIGNMENT

This invention relates generally to a developer system for an electrophotographic printing machine, and more particularly concerns a backer member for the photoreceptor in a noncontact developer system.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In some printing machines such as those described above, a developing system utilizing a noncontact developer roll has been utilized. In these systems referred to as hybrid jumping development (HJD) systems, the development roll, better known as the donor roll, is powered by two development fields (potentials across an air gap). The first field is the ac jumping field which is used for toner cloud generation. The second field is the dc development field which is used to control the amount of developed toner mass on the photoreceptor. The toner cloud causes charged toner particles to be attracted to the electrostatic latent image. Appropriate developer biasing is accomplished via a power supply. This type of system is a noncontact type in which only toner particles are attracted to the latent image and there is no mechanical contact between the photoreceptor and a toner delivery device.

It is another feature that in printing machines there are now more modular components which allow user serviceability without the need for service technician intervention. However, there are certain critical parameters that must be maintained while still allowing easy modular replacement of components. For example, the distance between a developer donor roll and the photoreceptive surface must be maintained within tight mechanical tolerances.

It is desirable to have a printing machine in which many subsystem components are easily serviceable and in most cases modular while still allowing a high print quality using sophisticated subsystems.

In accordance with one aspect of the present invention, there is provided a developer backer assembly for a noncontact development system, comprising a backer member located adjacent and in substantially axial alignment with a developer donor member and on an opposite side of a photoreceptive member having a latent image to be developed with toner particles, said backer member having a face surface which contacts the back of the photoreceptive member, wherein said face surface profile is defined by a plurality of radii having distinct origins so that the curvature of the face surface of the backer member varies so as to reduce drag on the back of the photoreceptive member and so that the photoreceptive member partially wraps around said face surface, a spacer member located adjacent the donor member to limit a distance between said backer member and the donor member and a biasing device for moving said backer member into contact with said spacer member.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
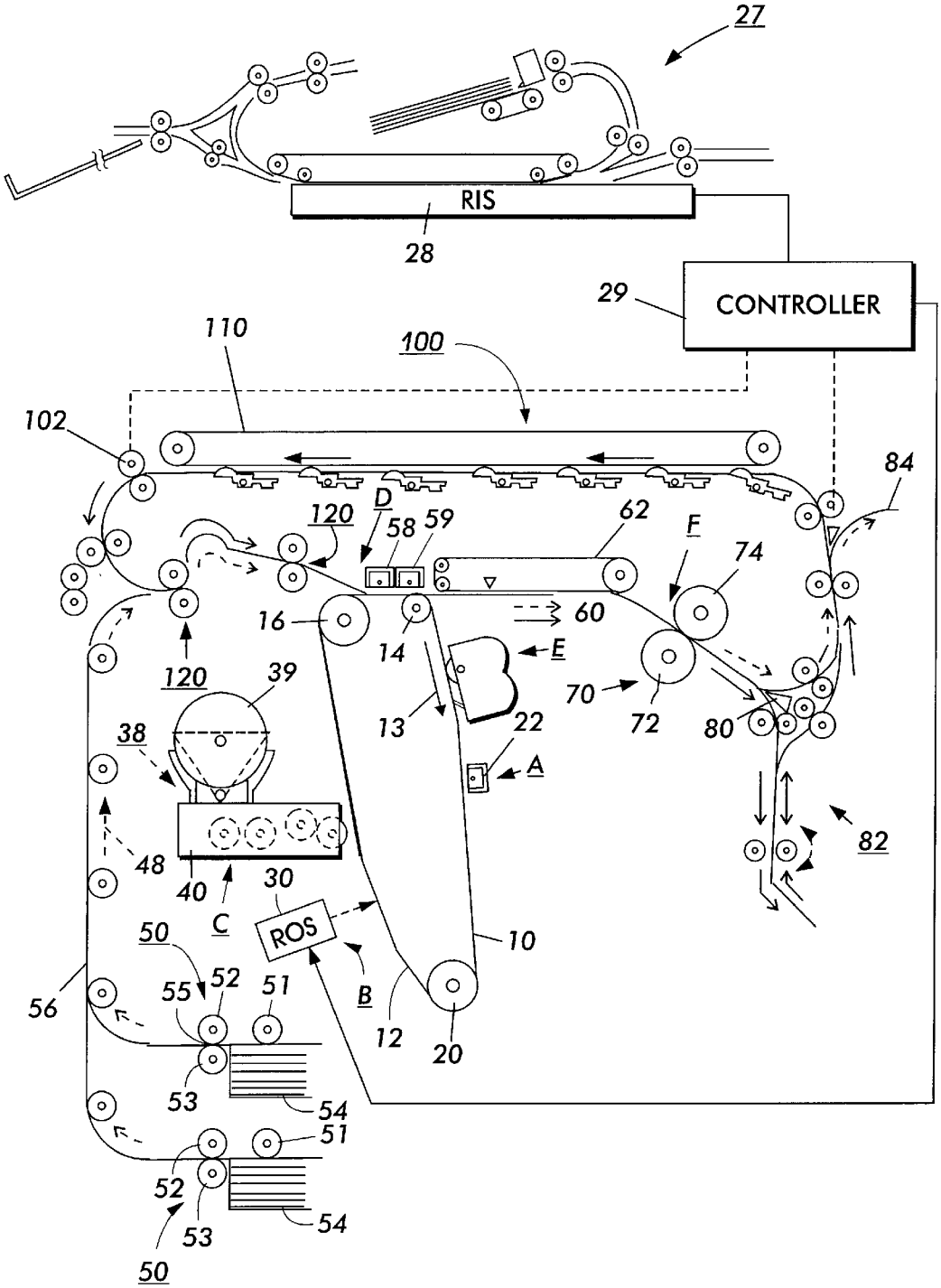
FIG. 1 is a schematic elevational view of a typical electrophotographic printing machine utilizing the developer backer member of the present invention.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the developer backer member of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) 30 described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the donor roll forming a toner powder image thereon. As successive electrostatic latent images are developed, toner particles are depleted from the developer material. A toner particle dispenser, indicated generally by the reference numeral 44, dispenses toner particles into developer housing 46 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a fuser release agent roll (not shown) and then to the fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Figure 2:
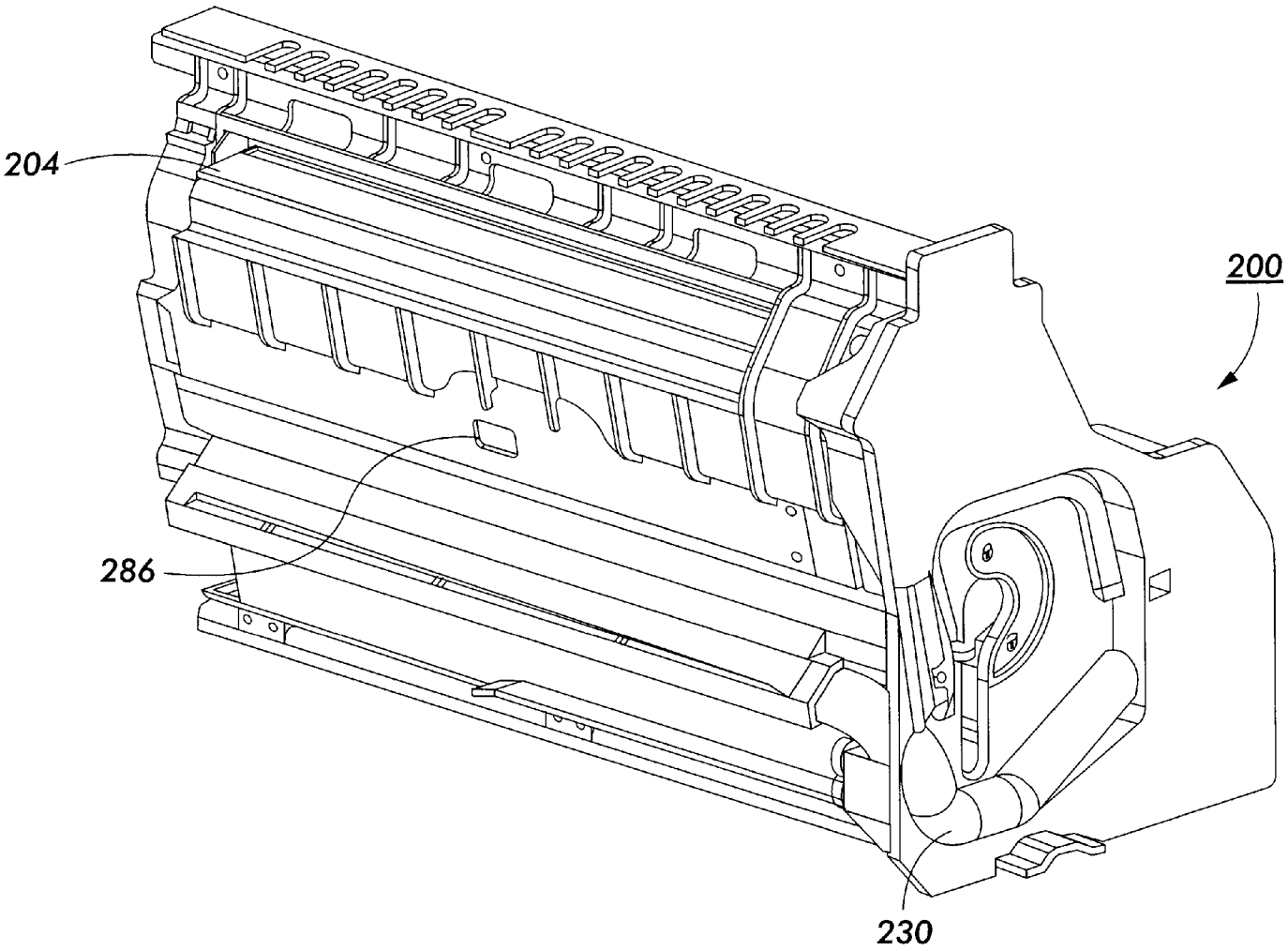
FIG. 2 is a perspective view of one side of a xerographic Customer Replaceable Unit (CRU)
Figure 3:
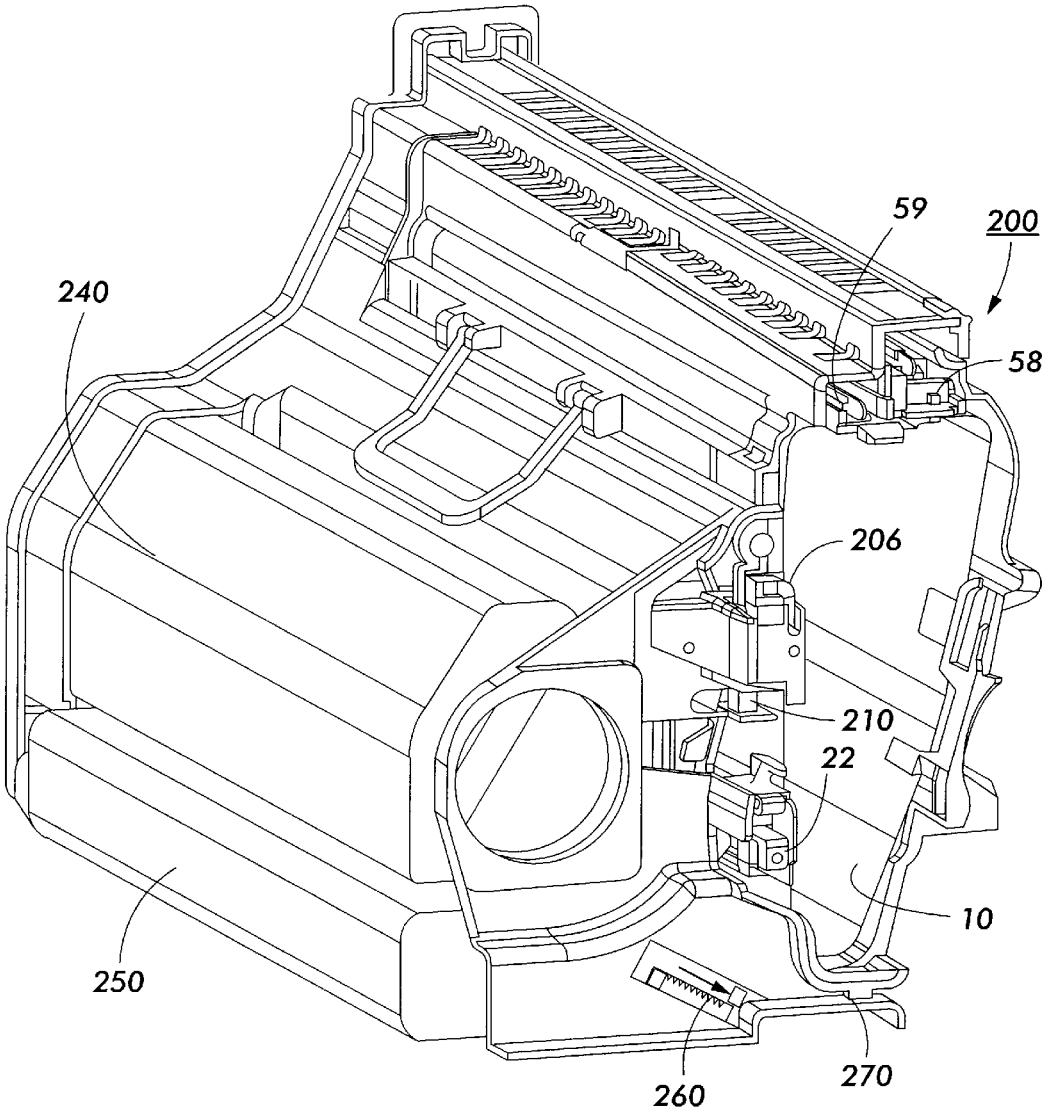
FIG. 3 is a perspective view of the opposite side of the FIG. 2 CRU.

Turning next to FIGS. 2 and 3, there is illustrated perspective views of the xerographic customer replaceable unit (CRU) 200. The xerographic CRU 200 module mounts and locates xerographic subsystems in relationship to the photoreceptor module 300 and xerographic subsystem interfaces. Components contained within the xerographic CRU include the transfer/detack corona generating devices 58, 59, the pretransfer paper baffles 204, the photoreceptor cleaner 206, the charge scorotron 22, the erase lamp 210, the photoreceptor(P/R) belt 10, the noise, ozone, heat and dirt (NOHAD) handling manifolds 230 and filter 240, the waste bottle 250, the drawer connector 260, Customer Replaceable Unit Monitor (CRUM) 270, the automatic cleaner blade engagement/retraction and automatic waste door open/close device (not illustrated).

A summary of the xerographic CRU components and the function of each is as follows:

Cleaner 206 (Doctor blade and Disturber Brush): remove untransferred toner from the photoreceptor; transport waste toner and other debris to a waste bottle for storage; assist in controlling the buildup of paper talc, filming and comets on the photoreceptor belt.

Precharge Erase Lamp 210: provides front irradiation of the photoreceptor to the erase the electrostatic field on the surface Charge Pin Scorotron 22: provides a uniform charge level to the photoreceptor belt in preparation for imaging.

Photoreceptor Belt 10: charge retentive surface advances the latent image portions of the belt sequentially through various xerographic processing stations which converts electrostatic field on the surface Pretransfer Paper Baffles 204: directs and controls tangency point between the paper and photoreceptor surface. Creates an "S" bend in paper to flatten sheet in the transfer zone.

Transfer Wire Corotron 58: places a charge on the paper as in passes under the corotron. The high positive charge on the paper causes the negative charged toner to transfer from the photoreceptor to the paper.

Detack Pin Corotron 59: assist in removing paper with its image from the photoreceptor by neutralizing electrostatic fields which may hold a sheet of paper to photoreceptor 10. Sheet self strips as it passes over a stripper roll 14 on belt module 300.

NOHAD Dirt Manifolds 230 and Filter 240: removes airborne toner dirt and contaminates from the moving air before it leaves the CRU. The captured toner and contaminates are deposited in a dirt filter contained in the xerographic CRU.

Electrical Drawer Connector 260: provides connector interface for the CRUM provides input/output for machine control.

CRUM Chip 270: allows machine to send reorder message (user interface or automatically) for CRU or other; method to monitor number of copies purchased by the customer and warrantee the CRU for premature CRU failures; provides handshake feature with machine to ensure correct CRU installed in compatible machine; shuts down machine at the appropriate CRU kill point; enables market differentiation; enables CRU life cycle planning for remanufacture; enables remote diagnostics; provides safety interlock for the ROS.

ROS and developer Interface: provides a developer interface window to allow transfer of toner for imaging from developer donor roll 47 to P/R belt surface 12 latent image; Also, provides critical parameter mounting and location link which ties ROS 30 to P/R module 300 to ensure proper imaging and eliminate motion quality issues.

BTAC (Black Toner Area Coverage) Sensor Interface 286: provides interface window to monitor process controls.

Registration Transport Interface provides outboard critical parameter location and mounting feature.

Prefuser Transport Interface provides critical parameter location and mounting feature.

Figure 4:
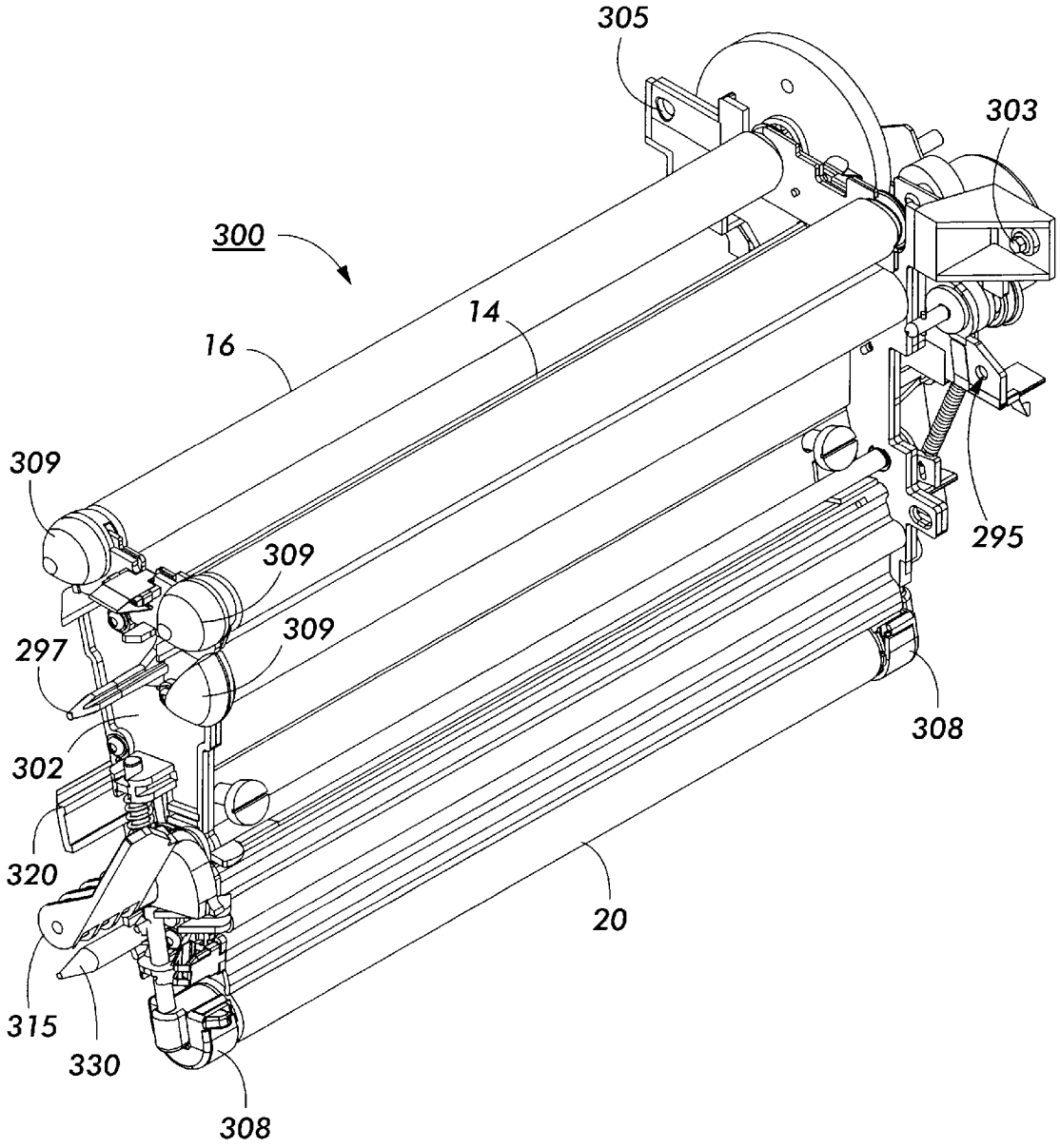
FIG. 4 is a perspective view of the photoreceptor belt drive module.
Figure 5:
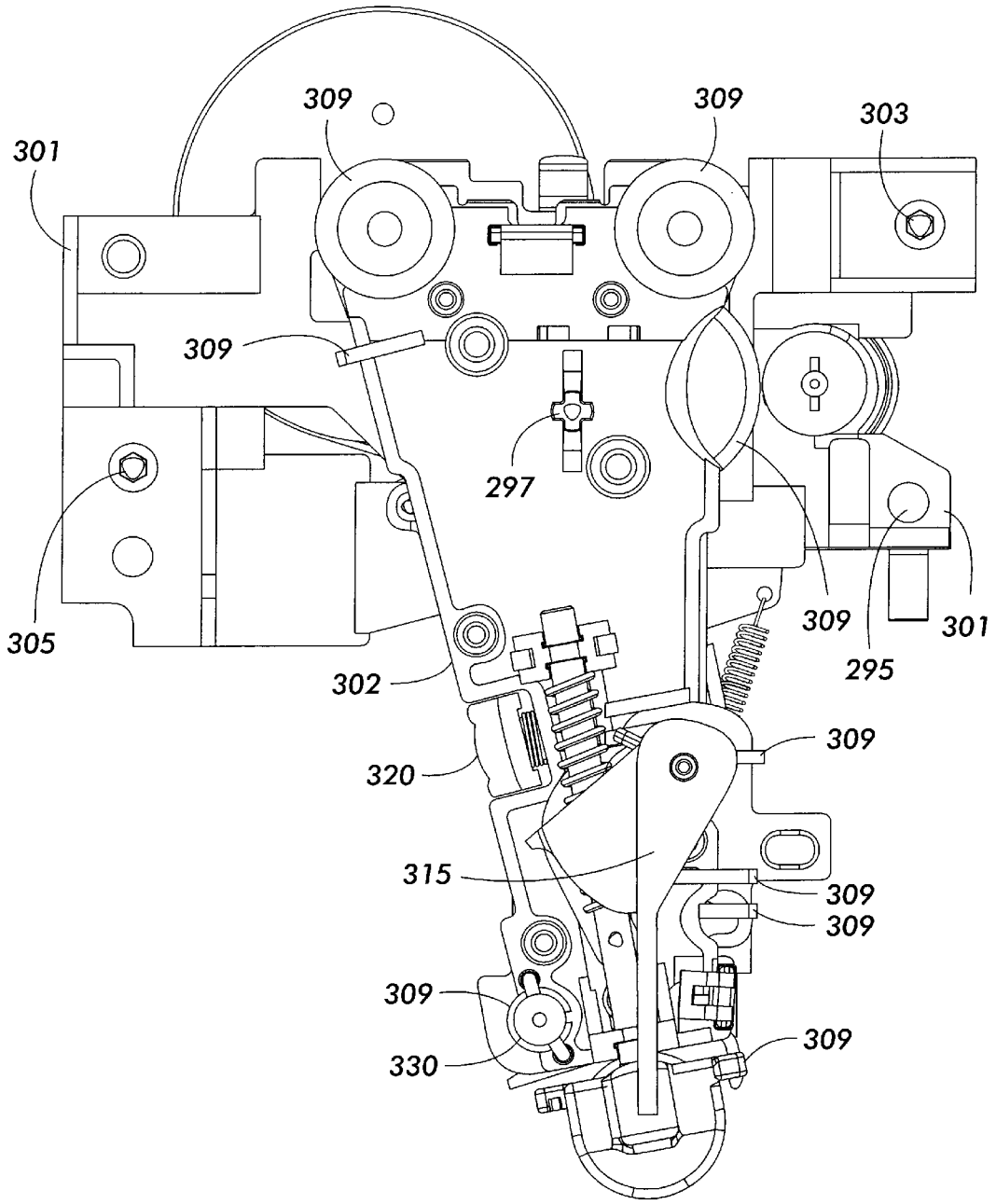
FIG. 5 is an end view of the FIG. 4 drive module.

The CRU subsystems are contained within the xerographic housing. The housing consist of three main components which include the front end cap, right side housing and left side housing. The xerographic housing is a mechanical and electrical link. It establishes critical parameters by mounting and locating subsystems internal and external to the CRU in relationship to the photoreceptor module 300 and other xerographic subsystem interfaces. The housing allows easy reliable install and removal of the xerographic system with out damage or difficulty, Turning next to FIGS. 4 and 5 the P/R module 300 is shown, the module, generally referred to as reference numeral 300, must interface with several sub systems: xerographic charging, imaging, development, paper registration, transfer, cleaning, erase, the machine frames, and the xerographic CRU. The unit's primary function is to rotate the photoreceptor (P/R) belt 10 to the various xerographic sub systems in order to transfer a toner image from the belt to a sheet of paper.

The photoreceptor (P/R) module 300 is mounted to the machine frames on the machine frames backplate with two fasteners using mounting holes 303, 305. The imager backer bar 330 locates in a hole in the machine frame's backplate. A second feature, to eliminate rotation, is on the P/R module rear plate 301. When mounted, the P/R module 300 is cantilevered off the machine frames backplate until the xerographic CRU 200 is inserted into position.

By rotating the P/R module handle 315 clockwise to a substantially vertical position, the tension roll 20 and developer backer bar 320 are contracted, allowing the user to insert/remove the xerographic CRU 200 without interference or damage to components. After the xerographic CRU 200 is fully inserted, the user rotates the handle 315 counter clockwise approximately 150° to return the tension roll 20 and developer backer bar 320 to their operating positions.

The xerographic CRU 200 locates to the P/R module 300 in the rear with a hole/pin 295, interface between the xerographic CRU 200 and the rear plate 301 of the P/R module 300. The front interface is also accomplished this way, however the pin 297 on the front plate 302 of the P/R module 300 and the image backer bar 330 on the P/R module 300 are supported by the xerographic CRU 200. The front plate of the PIR module 302, along with the P/R module handle 315 and the P/R module edge guides 308 have features 309 to guide the P/R belt 10 over the front of the P/R module 300 assembly eliminate P/R belt damage due to insertion to the xerographic CRU 200.

Figure 6:
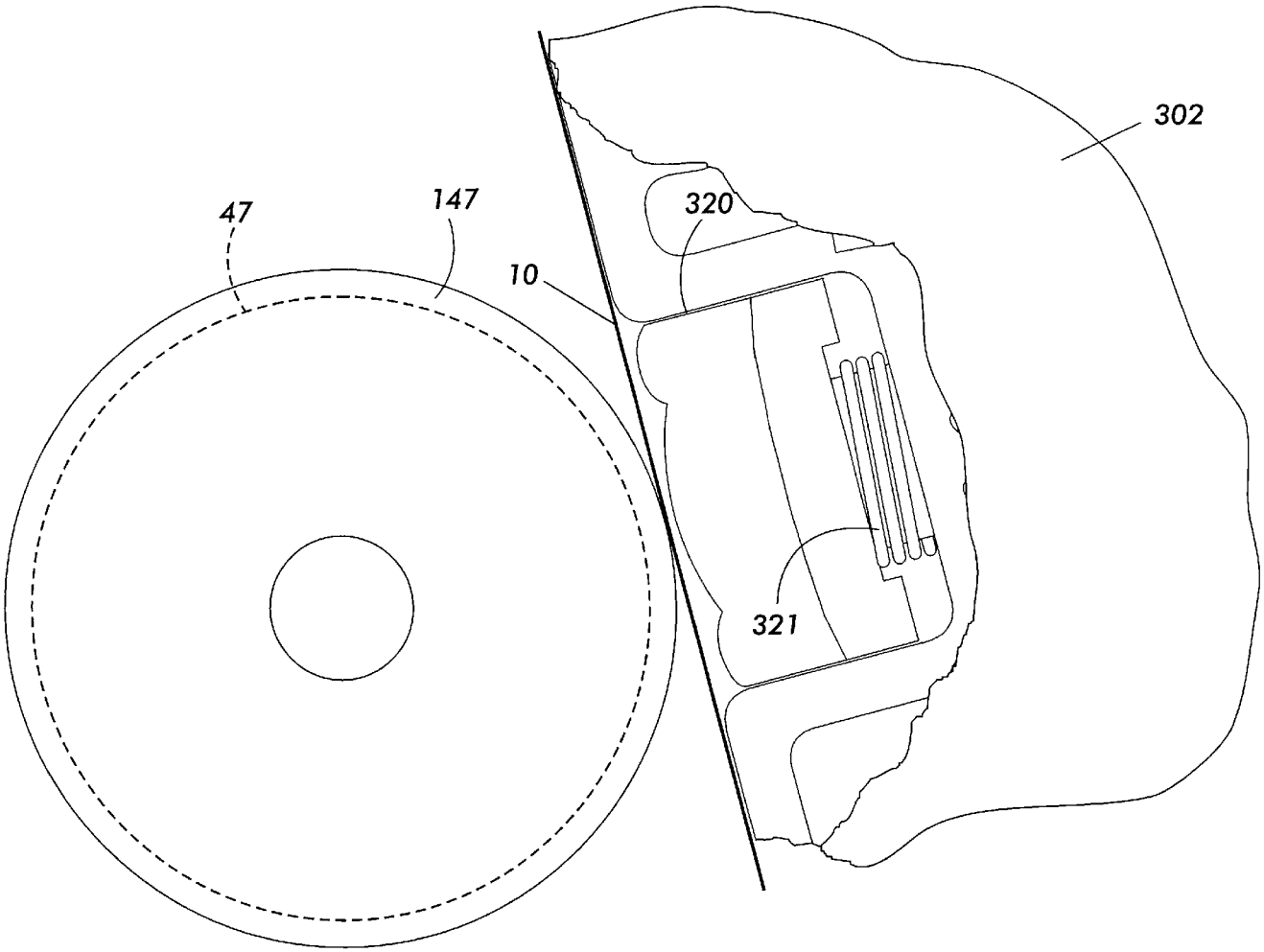
FIG. 6 is a partial view of the drive module illustrating the developer backer bar and the developer donor member with the backer in the retracted position.
Figure 7:
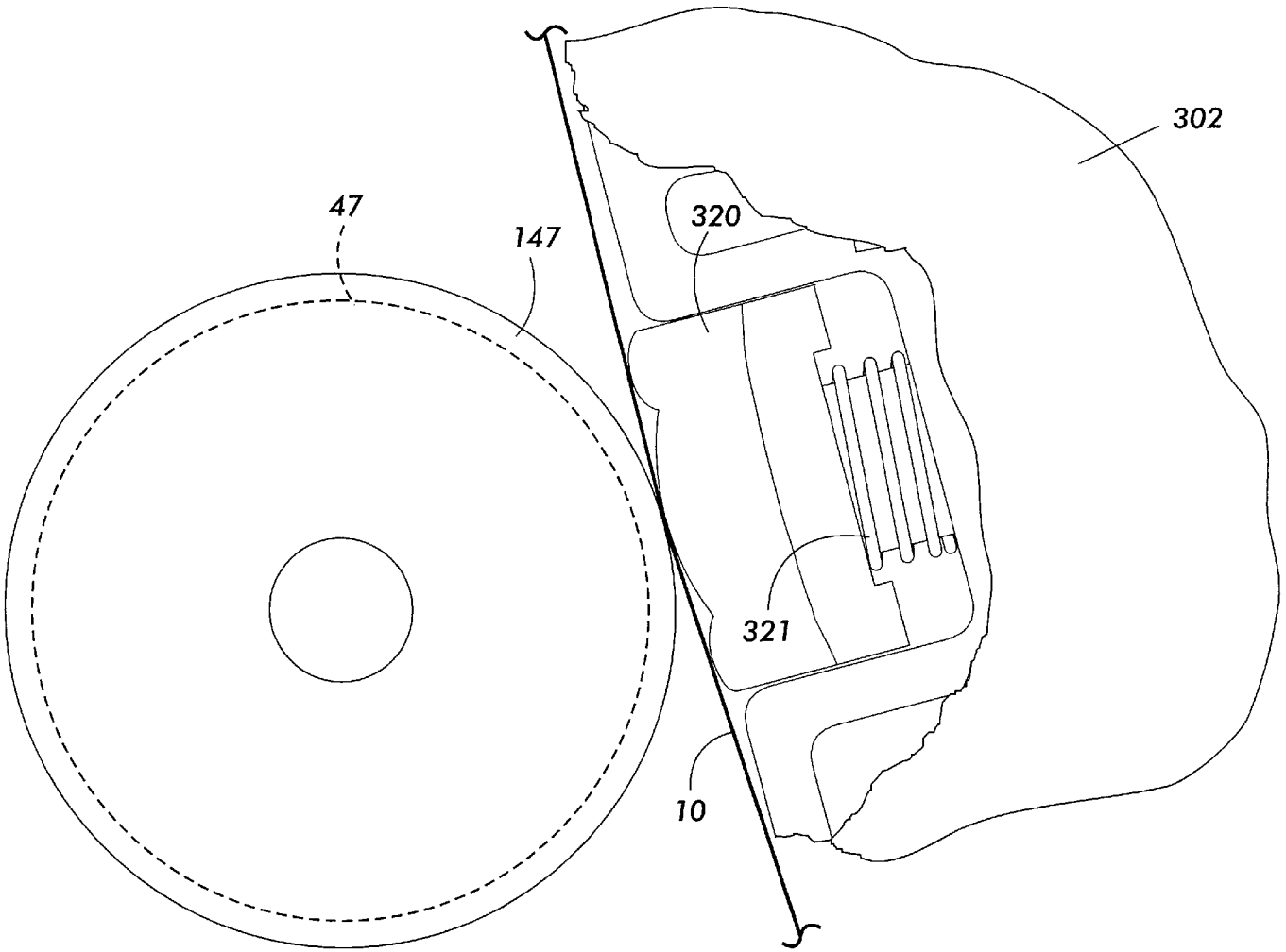
FIG. 7 is a partial view of the drive module illustrating the interface between the developer backer bar and the developer donor member with the backer member in the extended position.

As shown in FIGS. 6 and 7 the developer backer bar 320 is initially in a retracted position away from contact with the donor roll 47. When the backer bar 320 is extended by actuation of the handle 315, the backer 320 is forced against locators 147 on the developer donor roll 47 with two compression springs 321. The locators 147 provide an insulative bearing surface that the P/R belt is biased into contact with by the developer backer bar 320. As stated previously, the developer backer bar 320 is contracted away from the developer prior to xerographic CRU insertion/removal.

Typically, the use of rotating or stationary backers are used to support the flexible Photoreceptor Belt as it passes through key xerographic areas of the machine. Many devices have been used in the past as backers, most of which are round in shape, quite often approximately 12–30 mm in diameter. By wrapping the Photoreceptor Belt against these backers by as little as 1°, the Photoreceptor Belt "flattens" at the backer and a uniform interface zone is maintained. By using a flat backer, the Photoreceptor Belt will only touch the two sides of the flat backer and the belt will still be flexible over the majority of the backer.

The gap relationship between the photoreceptor of many printing machines and the donor roll of the developer assembly has to be held within ±0.001". Each contributing sub system is typically allotted a tolerance band of 0.001" to accomplish this. The diameter of an illustrated donor roll 47 of the developer assembly is approximately 25 mm; therefore as the profile of this diameter moves away from the photoreceptor belt, the gap between the two sub systems increases.

In order to maintain a wide enough width for toner transfer between the developer donor roll 47 and the photoreceptor belt 10, the gap change has to remain minimal. By shaping a rectangular bar (15 mm×20 mm) with a 50 mm center radius and a 3 mm corner radius on each side, the amount the photoreceptor belt moves away from the donor roll is minimal. This shape allows for an axial misalignment between the donor roll and the backer bar to be as high as ±1 mm while still maintaining the required gap. Therefore, no other device is required to align these two devices axially to one another. (FIG. 7) By utilizing the 3-50-3 shape, a wrap angle of 9° will result in approximately 3.2 mm of surface contact arc length vs 100 mm radius with the same wrap angle which results in approximately 15.4 mm of surface contact arc length. This smaller arc length results in lower drag forces between the bar and the belt.

The preferred photoreceptor developer backer bar with 3 radii, a center radius of 50 mm and two edge radii of 3 mm, the photoreceptor belt can be wrapped around the bar with a large (9°) angle while maintaining a minimal (3.2 mm) contact zone. The 9° of wrap will create a wide development zone allowing for a generous axial misalignment between the bar and the developer while maintaining a very tight gap. The 3.2 mm contact zone will keep friction low between the bar and the photoreceptor belt. The radii can be changed depending on the desired photoreceptor wrap angle for a particular printing machine to provide the necessary contact surface and low drag force.

While the invention herein has been described in the context a black and white printing machine, it will be readily apparent that the device can be utilized in any printing machine utilizing a noncontact developer and a removable P/R assembly.

In recapitulation, there is provided a developer backer bar having a plurality of radii for interfacing with a noncontact developer member. The backer bar is arranged so that it can be retracted for clearance purposes when removing or inserting a xerographic CRU. Upon installation of the CRU, the backer bar is biased into position to maintain a development zone within predetermined parameters. The multiple radii surface eliminates or minimizes errors that may result from slight variations in axial alignment between the backer bar and the developer member while additionally providing low drag forces on the photoreceptor.

It is, therefore, apparent that there has been provided in accordance with the present invention, a developer backer bar assembly that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A developr backer assembly for a noncontact development system, comprising:

a moveable backer member located adjacent to and in substantially axial alignment with a developer donor member and on an opposite side of a photoreceptive member having a latent image to be developed with toner particles, said backer member having a face surface which contacts the back of the photoreceptive member, wherein said face surface profile is defined by a plurality of radii having distinct origins so that the curvature of the face surface of the backer member varies so as to reduce drag on the back of the photoreceptive member and the photoreceptive member partially wraps around said face surface;

a spacer member located adjacent the donor member to limit a distance between said backer member and the donor member; and a biasing device for moving said backer member into contact with said spacer member.

2. A developer backer assembly for a noncontact development system, comprising:

a moveable backer member located adjacent to and in substantially axial alignment with a developer donor member and on an opposite side of a photoreceptive member having a latent image to be developed with toner particles, said backer member having a face surface which contacts the back of the photoreceptive member, wherein said face surface profile is defined by a plurality of radii having distinct origins so that the curvature of the face surface of the backer member varies so as to reduce drag on the back of the photoreceptive member, and so that the photoreceptive member partially wraps around said face surface;

a spacer member located adjacent the donor member to limit a distance between said backer member and the donor member; and a biasing device for moving said backer member into contact with said spacer member, wherein said biasing device comprises a spring in contact with said backer member and aligned so as to exert a force on said backer member in the direction of the donor member; and a retractor, to apply a force on said backer member opposite to that exerted by said spring.

3. An assembly according to claim 1, wherein said spacer member comprises an insulative surface to prevent developer electrical bias from being conducted to the photoreceptive member and the backer member.

* * * * *